US011740040B2

(12) United States Patent
Sylvester

(10) Patent No.: US 11,740,040 B2
(45) **Date of Patent: *Aug. 29, 2023**

(54) ADJUSTABLE CARRIER

(71) Applicant: Primary Weapons, Boise, ID (US)

(72) Inventor: Dean Sylvester, Boise, ID (US)

(73) Assignee: Evolved Gear LLC, Boise, ID (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/330,193

(22) Filed: May 25, 2021

(65) Prior Publication Data

US 2021/0278152 A1 Sep. 9, 2021

Related U.S. Application Data

(63) Continuation of application No. 16/934,880, filed on Jul. 21, 2020, now Pat. No. 11,015,883, which is a continuation of application No. 16/446,324, filed on Jun. 19, 2019, now Pat. No. 10,718,577.

(60) Provisional application No. 62/687,692, filed on Jun. 20, 2018.

(51) Int. Cl.
*F41A 3/26* (2006.01)

(52) U.S. Cl.
CPC ..... *F41A 3/26* (2013.01)

(58) Field of Classification Search
CPC ..... F41A 3/26; F41A 5/18; F41A 5/20; F41A 5/24; F41A 5/26
See application file for complete search history.

(56) References Cited

U.S. PATENT DOCUMENTS

| | | | | |
|---|---|---|---|---|
| 5,551,179 | A | 9/1996 | Young | |
| 6,681,677 | B2 | 1/2004 | Herring | |
| 7,316,091 | B1 | 1/2008 | DeSomma | |
| 7,444,775 | B1 | 11/2008 | Schuetz | |
| 8,590,199 | B2 | 11/2013 | Overstreet et al. | |
| 8,596,185 | B1 | 12/2013 | Soong et al. | |
| 9,372,038 | B1 | 6/2016 | Sylvester | |
| 9,625,225 | B2 | 4/2017 | Sylvester | |
| 9,857,129 | B1 | 1/2018 | Kelly et al. | |
| 10,718,577 | B1 * | 7/2020 | Sylvester | F41A 5/26 |
| 11,015,883 | B2 * | 5/2021 | Sylvester | F41A 3/26 |
| 2010/0282066 | A1 | 11/2010 | Tankersley | |
| 2013/0098235 | A1 | 4/2013 | Reinken | |
| 2014/0076143 | A1 | 3/2014 | Hall | |
| 2014/0090283 | A1 | 4/2014 | Gomez | |
| 2014/0224114 | A1 | 8/2014 | Faxon | |
| 2016/0076836 | A1 | 3/2016 | Young | |
| 2016/0202006 | A1 | 7/2016 | Daley, Jr. et al. | |
| 2018/0087854 | A1 | 3/2018 | Gray | |

(Continued)

*Primary Examiner* — J. Woodrow Eldred
(74) *Attorney, Agent, or Firm* — Dinsmore & Shohl LLP

(57) ABSTRACT

Disclosed herein is a modified rifle bolt carrier allowing a selectively openable vent/valve at the location where exhaust gas is pressurizing the bolt carrier to control carrier speed under suppressed fire in a first valve position or unsuppressed fire in a second valve position. A valve core is disclosed which may be rotated 180° to a first "open" setting for non-suppressed fire from its position in a "closed" position for suppressed fire, and a third "median" position. The modified bolt carrier will allow an operator of the firearm to adjust for a suppressor without changing the gas block or having to modify or adapt the front end or barrel end of the firearm.

11 Claims, 3 Drawing Sheets

(56) References Cited

U.S. PATENT DOCUMENTS

| | | | | |
|---|---|---|---|---|
| 2020/0025478 | A1 | 1/2020 | Bandurko | |
| 2020/0222975 | A1* | 7/2020 | Gill | C22F 3/02 |
| 2020/0363148 | A1 | 11/2020 | Sylvester | |

* cited by examiner

ADJUSTABLE CARRIER

RELATED APPLICATIONS

This application is a continuation of and claims priority benefit of U.S. Ser. No. 16/934,880 filed on Jul. 21, 2020. U.S. Ser. No. 16/934,880 claims priority benefit to U.S. Ser. No. 16/446,324 filed Jun. 19, 2019. U.S. Ser. No. 16/446,324 claims priority benefit to U.S. Provisional Ser. No. 62/687,692 filed Jun. 20, 2018 incorporated by reference.

BACKGROUND OF THE DISCLOSURE

Field of the Disclosure

This disclosure relates to the field of firearms modified for suppressed and un-suppressed fire, for varying powder loads, for varying projectile configurations, etc.

BRIEF SUMMARY OF THE DISCLOSURE

Disclosed herein is a firing assembly for a firearm. The assembly in one example comprising: a bolt carrier having a longitudinal axis, a surface defining a gas port. One example of the gas port in fluid communication with a gas block forward of a chamber of the firearm via a gas tube when the firearm is assembled. Also disclosed is a surface of the bolt carrier defining a valve housing in fluid communication with the gas port. Inserted into the valve housing is a valve core having an outer surface. The valve core configured to rotate within the valve housing without appreciable gas transfer between the outer surface of the valve core and the valve housing. One example of the valve core having a lateral end larger in diameter than the valve housing; a sealing member radially compressed between the valve core and the valve housing; and the valve core having a surface defining a port at least partially and selectively controls flow thorough the gas port.

The assembly may be arranged wherein the outer surface of the valve core is in close sliding fit to the valve housing so as to rotate therein.

The assembly may be arranged wherein the valve core comprises an indexing component; wherein the indexing component of the bolt carrier is in contact with an indexing surface of the bolt carrier, providing additional rotational friction to rotation of the valve core within the valve housing.

The assembly may be arranged wherein: the sealing member is configured to bias the valve core laterally; and wherein the sealing member is configured to laterally bias the indexing component toward the indexing surface.

The assembly may be arranged wherein: the valve core comprises a valve port surface which is detented from the substantially cylindrical outer surface of the valve core; and wherein the valve port surface is selectively aligned with the vertical gas port of the bolt carrier in an unsuppressed position such that the valve core does not substantially occlude the vertical gas port.

The assembly may further comprise a valve depressed surface on the valve body radially opposed to the valve port surface relative to the substantially cylindrical outer surface of the valve core.

The assembly may be arranged wherein; the valve core comprises an indexing component; and wherein the indexing component of the bolt carrier contacts an indexing surface of the bolt carrier, providing additional rotational friction to rotation of the valve core within the valve housing when the valve port surface is selectively aligned with the vertical gas port of the bolt carrier in an unsuppressed position.

The assembly may further comprise: a tool engagement surface on the valve core; the tool engagement surface not circularly symmetric; and a tool having a surface to cooperate with the tool engagement surface so as to selectively provide rotational force to the valve core when the tool is rotated.

The assembly may be arranged wherein the sealing member is radially compressed between the valve core and the valve housing.

DETAILED DESCRIPTION OF THE DISCLOSURE

Disclosed herein is a modification to a rifle bolt carrier providing a selectively openable and adjustable gas valve. In one example this gas valve is at the location where exhaust gas engages the bolt carrier. In one example, the valve is used to control carrier speed while shooting.

A valve body is disclosed configured to be rotated to adjust the volume of gas (air) that passes therethrough. The modification will allow an operator (shooter) of the firearm to adjust the carrier movement without changing the gas block and without having to modify or adapt the front (muzzle) end of the firearm.

Figure 18:
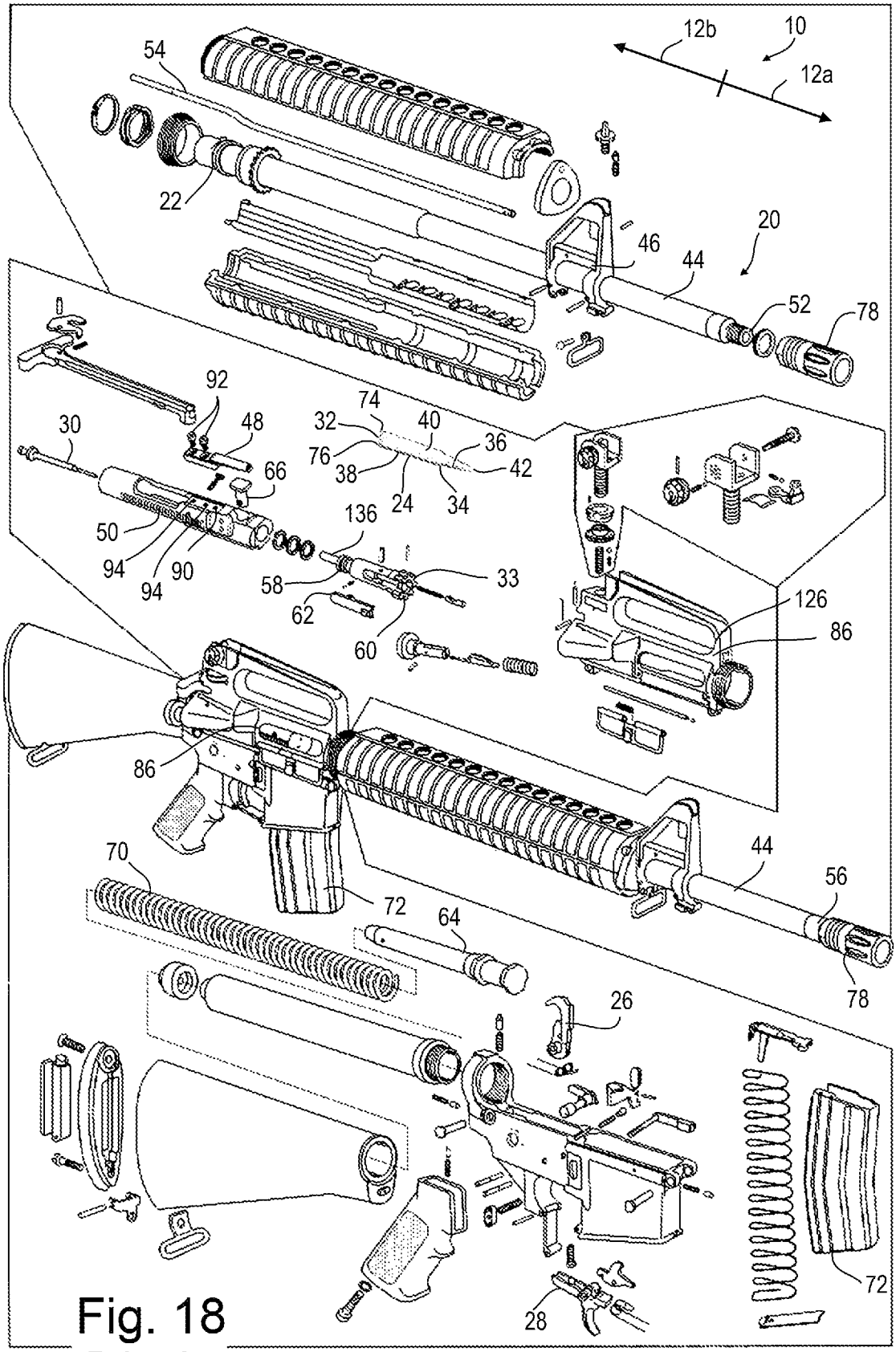
Fig. 18 Prior Art
FIG. 18 shows a prior art firearm and several components thereof shown in a combination exploded view.

A description of operation of an AR 15 style firearm and apparatus is included herein to give background to the invention. It is to be understood that this is one example, and the apparatus may be applied to SR25, AR10, and other firearm platforms. On example of this is shown in FIG. 18, representing known parts of such a firearm 20. Although an AR15 firearm is used as a specific example for description in this disclosure, it is to be understood that the modification disclosed herein may be applied to other firearms having equivalent components and/or operation. This example shows a cartridge 24 configured to fit in the chamber 22. This example further showing a hammer 26 in a rearward position. When fired, the user (shooter) actuates a trigger 28 which releases the hammer 26 towards a firing pin 30. The hammer contacts the firing pin 30, driving the firing pin 30 forward towards the primer portion 32 of the cartridge 24.

An understanding of "headspace" in this context aids in understanding the description herein. In describing firearms and firearm operation, headspace is the distance measured from the part of the chamber 22 that stops forward motion of the cartridge 24 (the datum reference) to the face 33 of the bolt 58. The term "headspace" used herein refers to the interference created between the inner surface of the chamber 22 and the feature(s) (shape) of the cartridge 24 that achieves the correct positioning of the cartridge 24 in the chamber 22. Different cartridges 24 have their datum lines in different positions in relation to the end surfaces of the casing 38. For example, 5.56 NATO ammunition headspaces off the shoulder 34 of the cartridge 24, whereas .303 British headspaces off the rim 36 of the cartridge 24. If the headspace is too short, even cartridges that are in specification may not chamber correctly. If headspace is too large, the casing 38 of the cartridge may rupture when fired, possibly damaging the firearm and injuring the shooter.

Before continuing with a description of the disclosed apparatus, an axes system 10 is shown in the drawings. The axes system 10 including a longitudinally rearward direction and a longitudinally forward direction, each along the longitudinal axis 12. The axes system including a lateral axis 14 orthogonal the longitudinal axis 12 and parallel to the axis of rotation 18 of the valve core to be described in detail. The axes system also including a transverse axis 16 orthogonal to the longitudinal axis 12 and the lateral axis 14.

Returning to a description of the firing system; as the firing pin 30 continues moving longitudinally 12 forward 12*a* to impact and ignite the primer 32, the primer detonation ignites the powder charge 40 within the cartridge 24, creating pressure within the cartridge casing 38. As the cartridge 24 expands radially outward towards the radially inward chamber walls; the chamber holds the casing 38 in place. As the casing 38 stretches longitudinally rearward, the case head 76 is stopped against the bolt face 33.

It is common for the casing 38 which is commonly made of brass to stretch rearward up to 2-4 thousandths of an inch when fired. The casing will return to its original shape and size when chamber pressure subsides. This also allows for reloading for center fire primers.

It is generally undesirable to provide headspace for the cartridge 24 to yield (permanently stretch) as the casing 38 is often thin just above the extraction groove. Excessive headspace is evident on a casing as a shiny ring, often about ⅛" forward of the extraction groove.

Upon detonation of the powder charge 40, the bullet 42 (projectile portion of the cartridge) begins movement down the barrel 44 of the firearm 20, first encountering the throat of the barrel 44. It is often important for the throat diameter to closely match the bullet diameter. Generally, oversized throats do not control the bullet 42 and do not keep the bullet 42 as straight while engraving into the rifling of the barrel 44.

As the bullet 42 travels down the barrel, the bullet 42 may expand radially outward into the rifling, where pressure causes the rifling lands to "engrave" into the bullet. Depending on the aspect ratio of the lands to grooves, the bullet 42 will sometimes increase in length. This change in bullet 42 shape can often be detrimental to accuracy. As the bullet 42 has obturated and engraved into the rifling the bullet 42 accelerates down the bore 52 of the barrel 44.

As the bullet approaches a gas port/gas block 46 of the firearm, expanded gas begins to flow into the gas block 46 where it flows towards the bolt carrier 50 via the gas tube 54 and bolt carrier key 48. The bolt carrier key 48 may be attached to or formed with the top of the bolt carrier 50.

While shooting the firearm 20, the gas pressure is relatively high in the barrel 44, often 15,00 PSI+ until the bullet 42 leaves the muzzle end 56 of the barrel. As the bullet 42 leaves the muzzle end 56, gas escapes the barrel 44 around the base of the bullet 42.

High pressure gas will flow along the path of least resistance, at this point out the muzzle end 56 of the barrel 44 instead of into the gas system driving the bolt carrier 50 and associated components rearward 12. As the bullet 42 exits the barrel 44; pressure within the barrel 44 and chamber 22 drops. During the bullets travel down the barrel 44 some pressurized gas travels from the gas block 50 through the gas tube 54 to the bolt carrier key 48.

The gas (pressure) upon reaching the bolt carrier key 48 is conducted to the bolt carrier 50 where the pressurized gas expands. Gas expanding in this region of the bolt carrier 50 forces the bolt carrier 50 rearward 12*b* and simultaneously forces the bolt 58 longitudinally forward 12*a*. The bolt 58 is also forced rearward by the gas pressure expanding the cartridge casing 38. For a short moment in time, these forward 12*a* and rearward 12*b* forces are substantially equal. During this moment, the bolt lugs 60 unlock prior to the extractor 62 forcing the spent casing 38 rearward and laterally outward through ejector port 86. At this point the bolt carrier 50 begins to move rearwards 12 against the inertia of the bolt carrier's weight, the weight of a buffer 64, and the tension of an operating spring 70. All of these relative movements affect timing of the mechanical operation as the firearm 20 is fired. Buffers 64 are provided in several "weights" to account for these and other factors: standard, heavy (H), H2, H3 etc.

As the bolt carrier 50 travels rearward, a cam pin 66 provided through the bolt encounters cam surfaces. Rearward movement of the bolt carrier 50 as the cam pin 66 contacts the cam surfaces causes the bolt 58 to rotate relative to the chamber 22.

As the firearm 20 is fired, gas pressure in the casing 38 holds the casing 38 into the chamber 22, even though the chamber 22 may be slightly tapered.

As the gas pressure is released out the muzzle end 56 of the barrel 44, the cartridge casing 38 will substantially return to its previous size. Thus, the casing 38 is no longer a tight fit in the chamber 22 as during firing when the gas pressure within the casing 38 is high.

It is important to operation that the bullet 42 exits the muzzle end 56 of the barrel 44 and the gas pressure within the casing 38 reduces enough that the casing 38 returns substantially to its pre-fired size, before the bolt lugs 60 are unlocked. Often, when the pressure is high during this operation, the casing 38 can become jammed in the chamber 22. One indicator of such high pressures is that the casing 38 extrudes into the ejector plunger hole on the bolt 58 and the resulting pressure unlocks the bolt 58 while gas pressures are still high.

Returning to a description of extraction of the spent cartridge 24 or casing 38, as pressure subsides, the bolt 58 is unlocked, bolt carrier 48 momentum continues rearward 12, pulling the spent cartridge casing 38 from the chamber 22.

As the casing 38 reaches the ejection port 86, the spent casing 38 pivots on the extractor hook from pressure of the ejector until the spent casing 38 is ejected from the firearm 20 through the ejector port 68.

The bolt carrier 48 continues rearward after ejection of the spent cartridge 24 while re-setting the hammer 26 of the firearm 20 to a position ready for firing until operating spring 70 pressure on the buffer 64 stops rearward 12 motion of the bolt carrier 48.

Once rearward 12 motion of the bolt carrier 48 ceases, the operating spring 70 (buffer spring) returns the bolt carrier 48 forward. As the bolt carrier 48 travels forward the mechanism strips a new unfired cartridge 24 from the magazine 72 up a feed ramp and into the chamber 22. The cartridge 24 stops forward 12*a* motion as the cartridge 24 is seated in the chamber 22, the bolt 58 continues forward, causing the extractor 62 to snap over the rim 74 of the cartridge casing 38. The bolt 58 will stop against the case head 76, and the bolt carrier 50 continues longitudinally forward 12*a*. The cam surfaces of the bolt carrier 48 then cause the bolt 58 to lock into firing position. The firearm 20 is then set as described at the beginning of this process.

When shooting, many shooters prefer to use sound or flash suppressors 78 on firearms 20 to reduce muzzle audio volume or muzzle flash. One problem with such suppressors 78 is the effect such suppressors 78 have on firearm function, particularly to bolt carrier 48 movement during firing. Gas pressure increases within the gas tube 54 and bolt carrier key 48 is a common result of suppressor attachment to firearms.

A semi-automatic firearm for example requires a specific volume/pressure of gas directed to the bolt carrier 48 to function properly as described above. When fired without a suppressor for example, the majority of excess gas pressure expands out of the muzzle end 56 of the barrel 44 into the atmosphere after the bullet 42 exits the bore 52. When that same gas pressure is affected by a suppressor's baffles, instead of exiting freely from the muzzle 56, a significant volume of pressurized gas is held in the gas system/barrel 44. Some of this compressed gas is directed to the gas block 50, through the gas tube 54, to the bolt carrier 50. The resulting greater force applied by this increased pressure/volume of gas to the bolt carrier 50 is often more than needed to operate the action of the bolt carrier 50 and bolt 58, and therefore can result in malfunction or damage of the firearm. The same effect can be caused by variances in powder charge 40, bullet 42 size, weight, shape, tension of the operating spring 70, and other variables. A modification is thus disclosed herein of a valve 82 to offset such variance in gas pressure.

Direct-gas-impingement systems as disclosed above, are typically non-adjustable as built. While user-adjustable regulators are available as commercial retrofits, they fail to fit the needs of shooters wishing to change from suppressed to non-suppressed fire in the field. These adjustable regulators often rely on setscrews for adjustment, or locking, and often lack positively indexed positions. Other known options to adjust changes to bolt and carrier speeds include installing heavier bolt carriers, changing buffer/operating springs 70 and changing buffers 64. Internal suppressor-design differences yield vastly different performance results depending in part on the firearm 20 to which they are attached and the cartridge 24 used.

As described, suppressors 78 and other variables normally affect pressure inside a firearm's gas system, in particular gas pressure provided to movement of the bolt carrier 48. Two known common ways to account for this change in gas pressure to the bolt carrier is to increase buffer 64 weight or use a hydraulic buffer.

Figure 1:
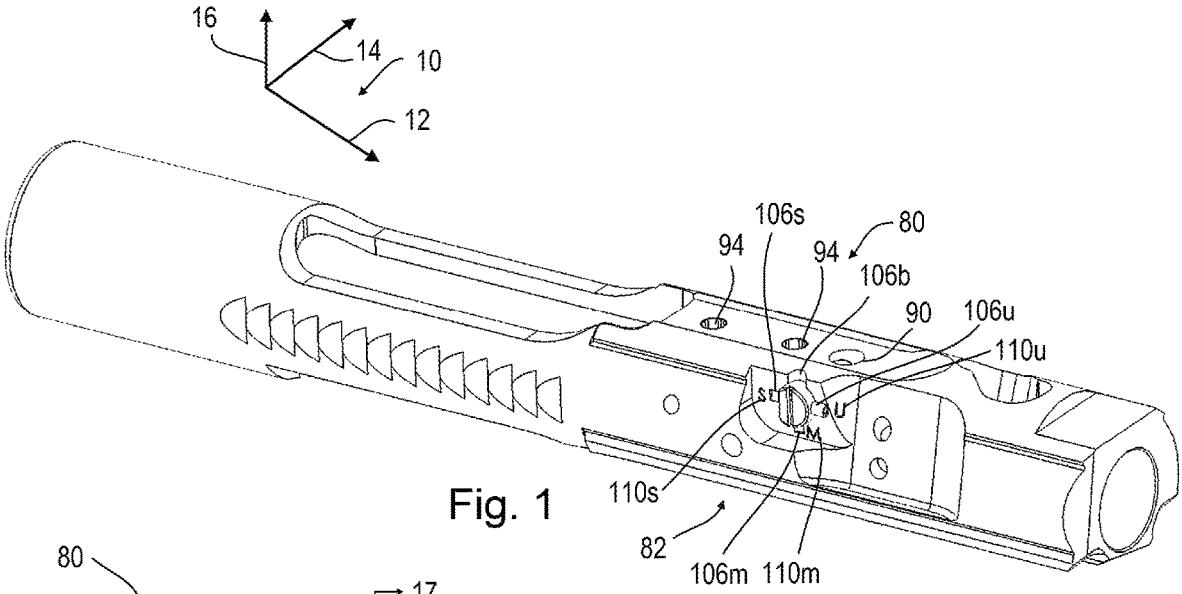
FIG. 1 is an isometric view of one example of the adjustable bolt carrier with gas regulator installed therein.
Figure 2:
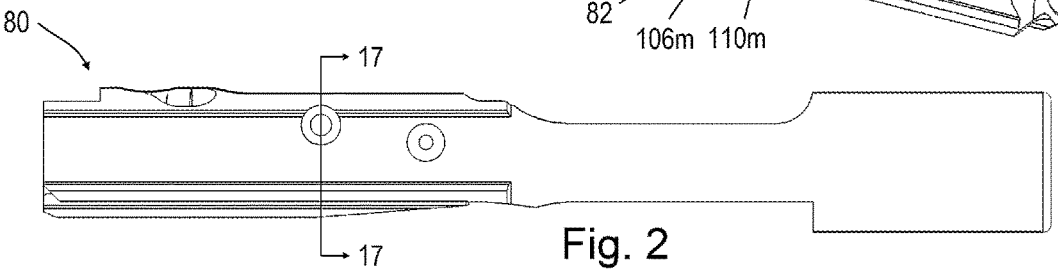
FIG. 2 is a first side view of the example shown in FIG. 1.
Figure 3:
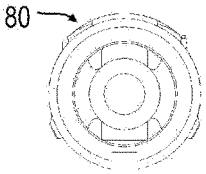
FIG. 3 is a first end view of the example shown in FIG. 1.
Figure 4:
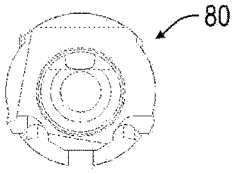
FIG. 4 is a second end view of the example shown in FIG. 1.
Figure 5:
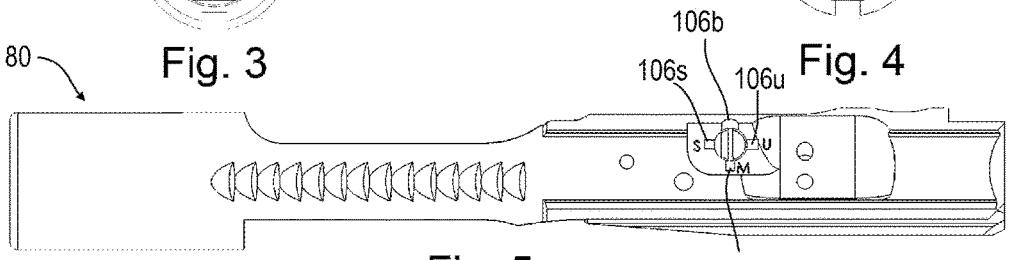
FIG. 5 is a second side view of the example shown in FIG. 1 from the opposing side as that shown in FIG. 2.

Disclosed herein as shown in the example of FIG. 1 is a modified rifle bolt carrier 80 providing a selectively openable valve 82 at a location where exhaust gas is directed from the bolt carrier key 48 (FIG. 18) to the bolt carrier 80 to control carrier speed under suppressed fire in a first valve position (S), unsuppressed fire (U) in a second valve position, and/or medial fire (M) in a third position. In other examples, the valve 83 may be configured without indexing, or may be indexed to other variables including powder charge 40, bullet 42 weight, barrel 44 length, suppressor 78, etc.

To adjust operation of the gas operated bolt carrier 80, the valve 82 comprising a valve core 84 may be fitted within a surface defining a valve housing 88 (FIG. 16) as disclosed. In one example, the disclosed system includes a valve core 84 which may rotate between a first or "open" (U) position for un-suppressed fire, a second (S) position for suppressed fire, and a "median" (M) position.

In one example, an indexing surface 106 on the modified bolt carrier engages a surface of the valve 82 to index the valve core 84 at various positions. These indexing surfaces may be substantially indents into which an indexer engages as the valve core 84 rotates in the valve housing 88. The modified bolt carrier 80 with the valve 82 will allow an operator of the firearm 20 to adjust for a suppressor 78 or other variables such as powder charge, bullet size or configuration, weather, barometric pressure, etc. without changing the gas block 46 or changing the front (muzzle) end 56 of the firearm 20.

Figure 16:
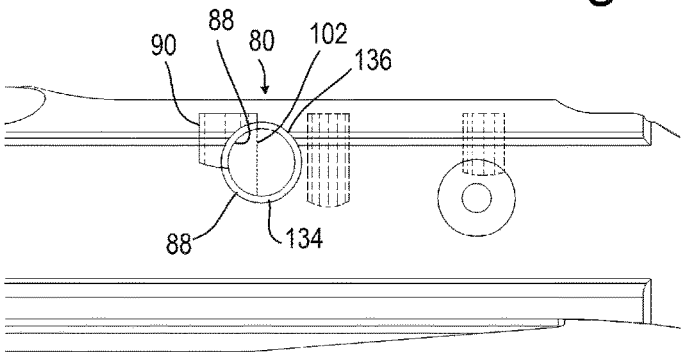
FIG. 16 is a partial hidden line view of the adjustable carrier component of FIG. 1.

FIG. 16 shows a partial hidden line view of a section of the modified bolt carrier 80 shown orthogonal to a gas port 90. As shown, when the firearm 20 is assembled, the gas port 90 with all other components provides a fluid (gas) conduit from the barrel 44 (gas port 46) to the gas tube 54 via the bolt carrier key 48. The bolt carrier key 48 may be attached to the bolt carrier 80 by way of fasteners 92 which engage female threaded voids 94 in the modified bolt carrier 80. In another example, the bolt carrier key 48 may be formed with the bolt carrier 80. As shown, the gas port 90 provides a gas conduit from the bolt carrier key 48 to an inner chamber 96 of the modified bolt carrier 80 as previously described. The valve 82 as described comprises several components including the valve core 84 fitted into the valve housing 88 which in this example comprises a female surface 98 into which the outer surface 100 of the valve core 84 fits in a close sliding fit: one example shown in FIGS. 8-15. The surfaces 98/100 may be cylindrical, conic section, arcuate projections, or other shapes or combinations thereof. Substantially cylindrical surfaces are shown in the drawings for ease in illustration.

A close sliding fit is defined herein as an engineering fit between two parts without a noticeable gap there between. In such an assemblage there is no noticeable gap between the cylindrical outer surface 100 of the valve core 84 and the surface 98 of the valve housing 88 which may otherwise allow gas pressure to transfer there between.

To ensure a gas-tight (close sliding) fit, as well as to induce friction without stiction (the friction that tends to prevent stationary surfaces from being set in motion) a sealing member 114 may be provided. In one example, the sealing member 114 is pressed in a circumferential groove 116 in the valve core 84 to ensure proper placement and operation. The sealing member 114 may be a cylinder, toroid, cone, frusta of these surfaces, or other shapes. In one example as shown in FIG. 8-14 the sealing member 114 is a toroid-shaped O-ring prior to compression. A shape well known in the art. The sealing member 114 may be made of silicone, rubber, metal, plastic, Polyethylene, or equivalent materials. In one example the sealing member is substantially elastic, substantially returning to its original shape and size when not compressed/tensioned. In one example the sealing member 114 has a Durometer rating of between 30 and 70 on the Shore "A" scale. This allows for substantial compression during installation. The circumferential groove 116 may be conic, a toroid section, or may be cylindrical as shown, with a circumferential surface 118 and side surfaces 120*a* and 120*b*.

When installed in the valve housing 88, a first lateral end 122 of the valve core 84 fits within a recess 138 in the modified carrier 80 such that the first lateral end 122 does not project radially outward past the adjacent outer surface 140 of the modified bolt carrier 80. In this way, the first lateral end 122 of the valve core 84 does not contact the inner surface of the receiver 126 which would tend to be detrimental if not terminal to operation.

In one example, the second lateral end 128 of the valve core 84 comprises a surface defining a void 130. During assembly, the valve core 84 is inserted into a first lateral side 134 of the valve housing 88, and the sealing member 114 seals between the valve core 84 and the valve housing 88 to a fully inserted position. In one example, the sealing member 114 is compressed between the surface 120*a* of the valve core 84 and an inner lateral facing surface 136 of the valve housing. As so compressed, the sealing member 114 biases the valve core 84 laterally away from the surface 136. To offset this bias, a pin 132 or another component is utilized. The pin 132 may be pressed (e.g., press fit), threaded, welded, or otherwise secured to the valve core 84.

In one example, the indexing component 108 previously described and the pin 132 are the same structure, accomplishing both functions. In other examples the indexing component 108 and the pin 132 are separate structures.

Figure 17:
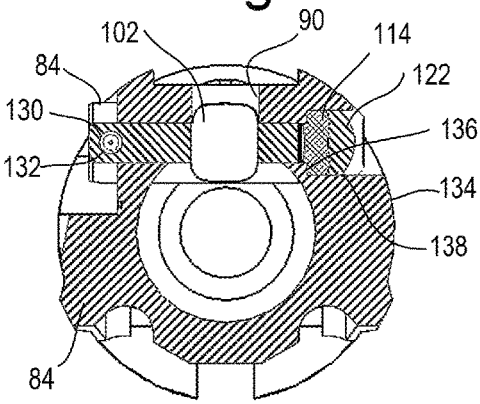
FIG. 17 is a cross-sectional view taken along line 17-17 of FIG. 2.

As can be seen in the cutaway view of FIG. 17, the sealing member 114 may be significantly compressed radially and laterally to form a seal, to provide constant friction between the valve core 84 and the valve housing 88 without stiction, and to laterally bias the valve core 84 away from the surface 136. This compression also pressing the pin 132 toward (into) the indexing surfaces 106. This bias increasing the effectiveness of the indexing system.

Figure 6:
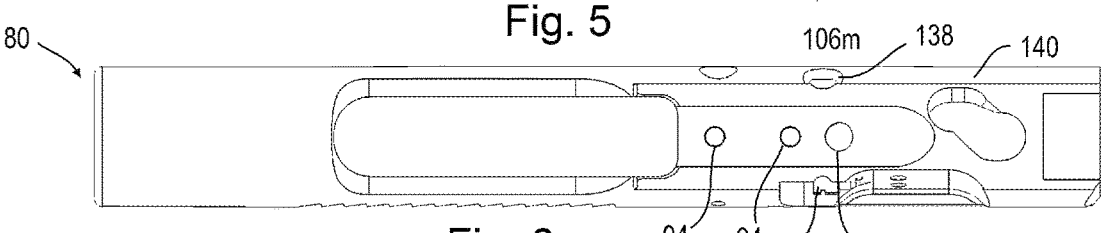
FIG. 6 is a top view of the example shown in FIG. 1.
Figure 7:
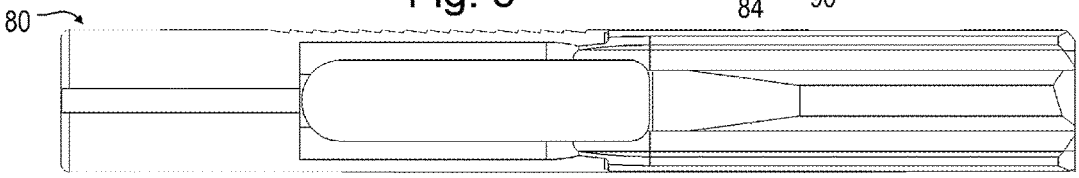
FIG. 7 is a bottom view of the example shown in FIG. 1.
Figure 8:
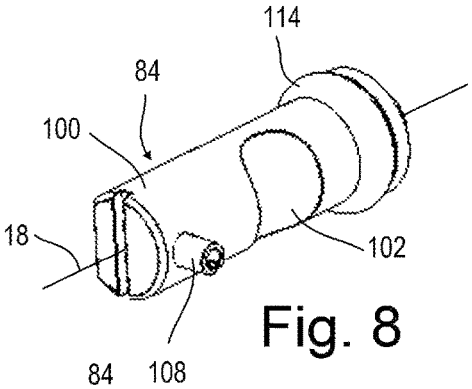
FIG. 8 is an isometric view of one example of valve core and sealing member components of FIG. 1.
Figure 9:
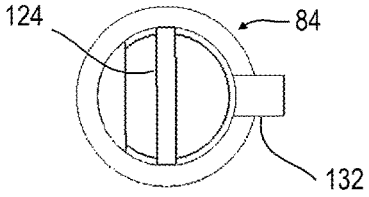
FIG. 9 is an end view of the example shown in FIG. 8.
Figure 10:
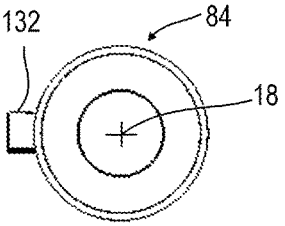
FIG. 10 is an opposing end view of the example shown in FIG. 9.

As can be appreciated by looking to FIG. 6, when the valve port surface 102 of the valve core 84 is aligned with the gas port 90, the valve core 84 provides little or no obstruction to gas transiting the gas port 90. In one example, this unsuppressed (U) position, allows use of the firearm without a suppressor. When the valve core 84 is rotated, the valve port surface 102 may not be aligned with the valve port 90. In such a position for example indexed positions "M" or "S", the valve core 84 occludes at least a portion of the gas port 90. In one example, this is a suppressed (S) position where use of the firearm with a suppressor is facilitated in that the valve core 84 reduces the gas volume and pressure transferring between the 48 and the bolt carrier 50.

Figure 11:
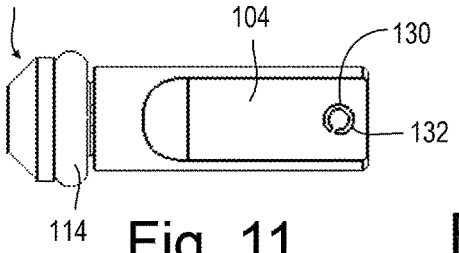
FIG. 11 is a top view of the example shown in FIG. 8.
Figure 13:
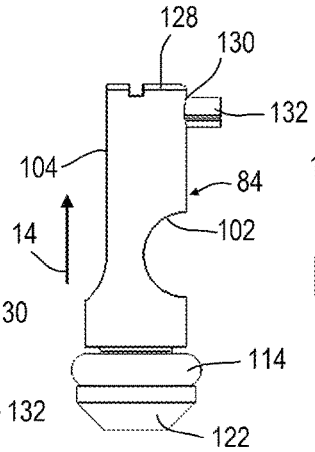
FIG. 13 is a side view of the example shown in FIG. 8.
Figure 12:
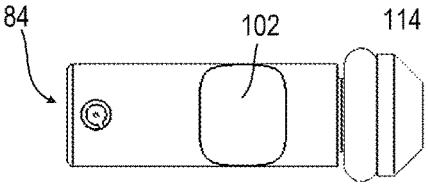
FIG. 12 is a bottom view of the example shown in FIG. 8.
Figure 14:
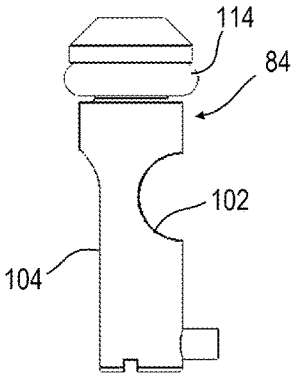
FIG. 14 is an opposing side view of the example shown in FIG. 13.
Figure 15:
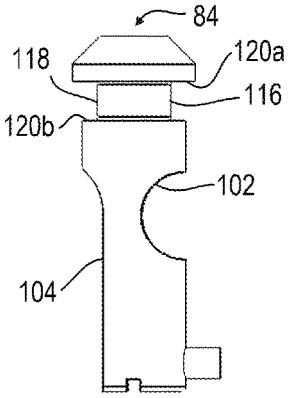
FIG. 15 is the same view as shown in FIG. 14 with a sealing member removed.

Looking to the example of FIGS. 11 and 13-14 it can be seen that the valve core 84 also comprises a valve depressed surface 104. While shown as a substantially planar surface, the valve depressed surface 104 may be specifically configured to conform to a specific combination of firearm/ammunition/suppressor to provide the proper gas flow there past through the gas port 90. When in the suppressed (S) setting the valve core 84 restrict the gas passing thereby. In this suppressed (S) setting, gas pressure is vented past the valve depressed surface 104. This structure resulting in a longer time for the pressure to build, in turn causing the action stay in lockup longer, and in turn direct more of the barrel pressure through the bore 52.

In the example shown a plurality of indexing surfaces 106 (106*b*, 106*s*, 106*u*, 106*m*) are provided on the bolt carrier 80. In one example these indexing surfaces 106 are grooves in the bolt carrier 80, extending radially from the rotational axis of the valve core 84. A corresponding indexing component 108 of the valve core 84 is configured to engage the surface 106 of valve core 84 relative to the bolt carrier 80. In addition, indicators 110 (110*s*, 110*m*, 110*u*) may be provided for indication of the position of the valve core 84 in an unsuppressed fire position (110*u*), suppressed fire position (110*s*) and median position (110*m*) respectively. Other indexing surfaces may be used for other variables.

In one example, to rotate the valve core, a shooter may use a tool to engage a tool surface 124.

In one example, the outer portion of the valve core 84 may comprise the tool engagement surface 124 for engagement with a tool 126 which in the example shown may be a flathead screwdriver not shown as such tools are commonly known. Other screwdriver designs, Allen wrenches, and drive patterns known in the art or designed for this specific purpose may be used. The tool allows the shooter to overcome rotational friction between the valve core 84 and the valve housing 88, including friction induced by the sealing member 114. The engagement portion of the tool is configured to interoperate with the engagement surface 124 and rotate the valve core 84 when the tool is rotated.

In one form, the tool and the mating surface 124 may comprise a surface which does not have circular symmetry. This surface may be used to engage the tool surface 124 as described above.

While the present invention is illustrated by description of several embodiments and while the illustrative embodiments are described in detail, it is not the intention of the applicants to restrict or in any way limit the scope of the appended claims to such detail. Additional advantages and modifications within the scope of the appended claims will readily appear to those sufficed in the art. The invention in its broader aspects is therefore not limited to the specific details, representative apparatus and methods, and illustrative examples shown and described. Accordingly, departures may be made from such details without departing from the spirit or scope of applicants' general concept.

The invention claimed is:

1. A firing assembly for a firearm, the assembly comprising:

a bolt carrier having a longitudinal axis, a surface defining a gas port, an inner chamber;

the inner chamber configured to be in fluid communication with a gas block via a gas conduit;

a surface of the firing assembly defining a valve housing, the valve housing intersecting the gas conduit;

a valve core having an outer surface immediately adjacent the valve housing;

the valve core configured to rotate within the valve housing;

the valve core having a first lateral end larger in diameter than the valve housing;

a sealing member pressed between the first lateral end of the valve core and the valve housing;

the valve core comprising a valve port surface which selectively controls gas flow thorough the gas conduit;

a second lateral end of the valve core comprises a radially protruding component; and wherein the radially protruding component of the valve core contacts a surface of the bolt carrier to bias the sealing member against the valve housing.

2. The assembly as recited in claim 1 wherein the outer surface of the valve core is in close sliding fit to the valve housing so as to rotate therein.

3. The assembly as recited in claim 2 wherein:

the outer surface of the valve core provides additional rotational friction to rotation of the valve core within the valve housing.

4. The assembly as recited in claim 3 a sealing member:

the sealing member configured to bias the valve core laterally.

5. The assembly as recited in claim 1 wherein:

the outer surface of the valve core is substantially cylindrical;

the valve port surface is detented from the outer surface of the valve core; and wherein the valve port surface is selectively aligned with the gas conduit of the bolt carrier when the firearm is in an unsuppressed position such that the valve core does not substantially occlude the gas port.

6. The assembly as recited in claim 5 further comprising:

a valve depressed surface on the valve body;

the valve depressed body radially opposed to the valve port surface relative to the substantially cylindrical outer surface of the valve core.

7. The assembly as recited in claim 5 wherein;

the radially protruding component is configured to index rotation of the valve core within the valve housing when the valve port surface is selectively aligned with the gas conduit in an unsuppressed position, suppressed position, or median position.

8. The assembly as recited in claim 1 further comprising:

a tool engagement surface on the valve core;

the tool engagement surface is not circular; and a tool having a surface to cooperate with the tool engagement surface so as to selectively provide rotational force to the valve core when the tool is rotated.

9. The assembly as recited in claim 1 further comprising a sealing member radially compressed between the valve core and the valve housing.

10. The assembly as recited in claim 9 wherein the sealing member comprises an O-ring.

11. The assembly as recited in claim 10 wherein the O-ring engages a circumferential groove in the valve core.

* * * * *